US008528458B2

(12) United States Patent
Windauer

(10) Patent No.: US 8,528,458 B2
(45) Date of Patent: Sep. 10, 2013

(54) PRESSURE-REGULATING GAS BLOCK

(76) Inventor: Bernard T. Windauer, Kalispell, MT (US)

( * ) Notice: Subject to any disclaimer, the term of this patent is extended or adjusted under 35 U.S.C. 154(b) by 223 days.

(21) Appl. No.: 13/191,668

(22) Filed: Jul. 27, 2011

(65) Prior Publication Data

US 2013/0025445 A1 Jan. 31, 2013

(51) Int. Cl.
*F41A 5/26* (2006.01)
*F41A 5/28* (2006.01)

(52) U.S. Cl.
USPC ..... 89/193

(58) Field of Classification Search
USPC ..... 89/191.01, 193
See application file for complete search history.

(56) References Cited

U.S. PATENT DOCUMENTS

| | | | |
|---|---|---|---|
| 454,403 | A | 6/1891 | Odkolek |
| 729,413 | A | 5/1903 | Reifgraber |
| 1,138,377 | A | 5/1915 | Hammond |
| 1,333,498 | A | 3/1920 | Lang |
| 1,350,961 | A | 8/1920 | Farquhar et al. |
| 1,366,863 | A | 1/1921 | Berthier |
| 1,382,058 | A | 6/1921 | Bourdelles |
| 1,388,879 | A | 8/1921 | Nelson |
| 1,431,057 | A | 10/1922 | Sutter |
| 1,738,501 | A | 12/1929 | Moore |
| 1,808,052 | A | 6/1931 | McCann |
| 2,003,066 | A | 5/1935 | Brondby |
| 2,058,897 | A | 10/1936 | Marek |
| 2,340,293 | A | 2/1944 | Balleisen |
| 2,369,669 | A | 2/1945 | Garand |
| 2,457,835 | A | 1/1949 | Schiff |
| 2,462,119 | A | 2/1949 | Moore |
| 2,554,618 | A | 5/1951 | Dixon |
| 2,685,754 | A | 8/1954 | Crittendon et al. |
| 2,715,858 | A | 8/1955 | Hoppert |
| 2,748,662 | A | 6/1956 | Simpson |
| 2,783,685 | A | 3/1957 | Green |
| 2,791,944 | A | 5/1957 | Harvey |
| 2,814,972 | A | 12/1957 | Simmons, Jr. |
| 2,845,008 | A | 7/1958 | Atwood, Jr. |

(Continued)

FOREIGN PATENT DOCUMENTS

| | | |
|---|---|---|
| BE | 332360 | 3/1926 |
| BE | 586850 | 2/1960 |

(Continued)

OTHER PUBLICATIONS

PCT/US2010/022293, International Search Report and Written Opinion, Oct. 26, 2011, 9 pages.

*Primary Examiner* — Bret Hayes

(57) ABSTRACT

A gas block assembly for a firearm comprises a gas cylinder fluidly coupled to the bore of a barrel of the firearm through a gas inlet port, and an automatically adjusting gas pressure relief port. The gas cylinder receives a gas pressure generated in the barrel of the firearm, and the gas pressure relief port vents gas pressure in the gas cylinder directly or indirectly into the bore of the barrel of the firearm or attached sound suppressor if the gas pressure in the gas cylinder is greater than or equal to a predetermined and preset gas pressure. A pressure relief mechanism is fluidly coupled between the gas cylinder and the gas pressure relief port and vents gas pressure from the gas cylinder to the gas pressure relief port if the gas pressure in the gas cylinder is greater than or equal to the predetermined gas pressure.

20 Claims, 13 Drawing Sheets

(56) References Cited

U.S. PATENT DOCUMENTS

| | | | | |
|---|---|---|---|---|
| 2,870,685 | A | 1/1959 | Harvey | |
| 2,872,851 | A | 2/1959 | Katz | |
| 2,895,383 | A | 7/1959 | Reed | |
| 2,909,101 | A | 10/1959 | Hillberg | |
| 2,918,848 | A | 12/1959 | Maillard | |
| 2,935,915 | A | 5/1960 | Janson | |
| 2,951,424 | A | 9/1960 | Stoner | |
| 2,987,968 | A | 6/1961 | Janson | |
| 3,020,807 | A | 2/1962 | Hailston et al. | |
| 3,024,706 | A | 3/1962 | Wild | |
| 3,036,501 | A | 5/1962 | Wild | |
| 3,127,812 | A | 4/1964 | Into et al. | |
| 3,246,567 | A | 4/1966 | Miller | |
| 3,261,264 | A | 7/1966 | Wilson | |
| 3,323,418 | A | 6/1967 | Loffler | |
| 3,330,183 | A | 7/1967 | Loffler | |
| 3,333,509 | A | 8/1967 | Muhlemann | |
| 3,359,860 | A | 12/1967 | Muhlemann | |
| 3,420,140 | A | 1/1969 | Beretta | |
| 3,443,477 | A | 5/1969 | Kaempf | |
| 3,592,101 | A | 7/1971 | Vartanian et al. | |
| 3,680,434 | A | 8/1972 | Muhlemann | |
| 3,690,219 | A | 9/1972 | Muhlemann et al. | |
| 3,707,110 | A | 12/1972 | Alday | |
| 3,709,092 | A | 1/1973 | Tazome | |
| 3,779,131 | A | 12/1973 | Kawamura | |
| 3,795,173 | A | 3/1974 | Freymond | |
| 3,810,412 | A | 5/1974 | Zamacola | |
| 3,893,370 | A | 7/1975 | Hutton et al. | |
| 3,945,296 | A | 3/1976 | Hyytinen | |
| 3,968,727 | A | 7/1976 | Hyytinen | |
| 3,982,468 | A | 9/1976 | Browning | |
| 3,988,964 | A | 11/1976 | Moore | |
| 3,990,348 | A | 11/1976 | Vesamaa | |
| 4,019,423 | A * | 4/1977 | Johnson | 89/178 |
| 4,102,243 | A | 7/1978 | Jennie | |
| 4,126,077 | A * | 11/1978 | Quesnel | 89/1.704 |
| 4,174,654 | A | 11/1979 | Liedke | |
| 4,244,273 | A | 1/1981 | Langendorfer, Jr. et al. | |
| 4,279,191 | A | 7/1981 | Johansson | |
| 4,373,423 | A | 2/1983 | Moore | |
| 4,414,880 | A | 11/1983 | Throner | |
| 4,418,608 | A | 12/1983 | Klumpp | |
| 4,599,934 | A | 7/1986 | Palmer | |
| 4,611,525 | A | 9/1986 | Bosshard et al. | |
| 4,693,170 | A | 9/1987 | Atchisson | |
| 4,702,146 | A | 10/1987 | Ikeda et al. | |
| 4,798,124 | A | 1/1989 | Hurlemann et al. | |
| 4,872,392 | A | 10/1989 | Powers et al. | |
| 4,901,623 | A | 2/1990 | Lee | |
| 5,218,163 | A | 6/1993 | Dabrowski | |
| 5,272,956 | A | 12/1993 | Hudson | |
| 5,351,598 | A | 10/1994 | Schuetz | |
| 5,404,790 | A | 4/1995 | Averbukh | |
| 5,429,034 | A | 7/1995 | Badali et al. | |
| 5,726,377 | A | 3/1998 | Harris et al. | |
| 5,824,943 | A | 10/1998 | Guhring et al. | |
| 5,831,202 | A | 11/1998 | Rustick | |
| 5,945,626 | A | 8/1999 | Robbins | |
| 6,374,720 | B1 | 4/2002 | Tedde | |
| 6,382,073 | B1 | 5/2002 | Beretta | |
| 6,516,700 | B1 | 2/2003 | Nikonov et al. | |
| 6,606,934 | B1 | 8/2003 | Rock et al. | |
| 6,622,610 | B2 * | 9/2003 | Adkins | 89/193 |
| 6,868,770 | B2 | 3/2005 | Cornils | |
| 7,213,498 | B1 | 5/2007 | Davies | |
| 7,467,581 | B2 | 12/2008 | Botty | |
| 7,469,624 | B1 | 12/2008 | Adams | |
| 7,594,465 | B2 | 9/2009 | Borgwarth et al. | |
| 7,610,843 | B2 | 11/2009 | Beretta | |
| 7,610,844 | B2 | 11/2009 | Kuczynko et al. | |
| 7,621,210 | B2 | 11/2009 | Fluhr et al. | |
| 7,637,199 | B2 | 12/2009 | Fluhr et al. | |
| 7,739,939 | B2 | 6/2010 | Adams | |
| 7,775,150 | B2 | 8/2010 | Hochstrate et al. | |
| 7,779,743 | B2 | 8/2010 | Herring | |
| 7,810,423 | B2 | 10/2010 | Monroe | |
| 7,827,722 | B1 | 11/2010 | Davies | |
| 7,832,326 | B1 | 11/2010 | Barrett | |
| 7,856,917 | B2 | 12/2010 | Noveske | |
| 7,891,284 | B1 | 2/2011 | Barrett | |
| 7,921,760 | B2 | 4/2011 | Tankersley | |
| 7,934,447 | B2 | 5/2011 | Kuczynko et al. | |
| 7,938,055 | B2 | 5/2011 | Hochstrate et al. | |
| 7,946,214 | B2 | 5/2011 | Stone | |
| 7,963,203 | B1 | 6/2011 | Davies | |
| 2002/0053280 | A1 | 5/2002 | Tedde | |
| 2004/0237766 | A1 | 12/2004 | Cornils | |
| 2005/0262752 | A1 | 12/2005 | Robinson et al. | |
| 2006/0236582 | A1 | 10/2006 | Lewis et al. | |
| 2007/0199435 | A1 | 8/2007 | Hochstrate et al. | |
| 2008/0276797 | A1 | 11/2008 | Leitner-Wise | |
| 2008/0307954 | A1 | 12/2008 | Fluhr et al. | |
| 2009/0000173 | A1 | 1/2009 | Robinson et al. | |
| 2009/0007478 | A1 | 1/2009 | Fluhr et al. | |
| 2009/0229454 | A1 | 9/2009 | Fluhr et al. | |
| 2010/0024636 | A1 | 2/2010 | Winge | |
| 2010/0199836 | A1 | 8/2010 | Herring | |
| 2010/0224056 | A1 | 9/2010 | Monroe | |
| 2010/0236396 | A1 | 9/2010 | Stone | |
| 2010/0275769 | A1 | 11/2010 | Brittingham | |
| 2010/0275770 | A1 | 11/2010 | Noveske | |
| 2010/0282066 | A1 | 11/2010 | Tankersley | |
| 2010/0319528 | A1 | 12/2010 | Kenney et al. | |
| 2011/0023699 | A1 | 2/2011 | Barrett | |
| 2011/0023700 | A1 | 2/2011 | Herring | |
| 2012/0167756 | A1 * | 7/2012 | Larue | 89/193 |

FOREIGN PATENT DOCUMENTS

| | | | |
|---|---|---|---|
| BE | 1015572 | | 6/2005 |
| CA | 2597441 | A1 | 7/2006 |
| CA | 2705534 | A1 | 5/2009 |
| CH | 29709 | | 12/1903 |
| CH | 50723 | | 9/1909 |
| CH | 90978 | | 9/1920 |
| CH | 101634 | | 3/1922 |
| CH | 147188 | | 5/1931 |
| CH | 481362 | | 12/1969 |
| CH | 631542 | | 8/1982 |
| DE | 597634 | | 2/1929 |
| DE | 609372 | | 1/1935 |
| DE | 712087 | | 1/1936 |
| DE | 648391 | | 7/1938 |
| DE | 1453904 | | 9/1969 |
| DE | 2302785 | | 8/1974 |
| DE | 2702679 | A1 | 2/1978 |
| DE | 2834332 | A1 | 8/1979 |
| DE | 2932710 | A1 | 3/1981 |
| DE | 196 18 181 | C2 | 10/1997 |
| DE | 694 12 384 | T2 | 3/1999 |
| DE | 103 18 828 | A1 | 11/2004 |
| EP | 0 114 205 | A1 | 8/1984 |
| EP | 0 167 067 | A1 | 1/1986 |
| EP | 0 380 041 | A1 | 8/1990 |
| EP | 1 052 470 | A2 | 11/2000 |
| EP | 1 471 325 | A1 | 10/2004 |
| EP | 1 471 325 | B1 | 9/2006 |
| ES | 257018 | | 3/1981 |
| ES | 2 336 031 | T3 | 9/2008 |
| FR | 17062 | | 6/1913 |
| FR | 22353 | | 7/1921 |
| FR | 563468 | | 12/1923 |
| FR | 747501 | | 6/1933 |
| FR | 763021 | | 4/1934 |
| FR | 1155066 | | 4/1958 |
| FR | 1235856 | | 5/1960 |
| FR | 1450319 | | 7/1966 |
| FR | 2 369 533 | A1 | 5/1978 |
| FR | 2 532 741 | A1 | 3/1984 |
| FR | 2 805 341 | A1 | 8/2001 |
| FR | 2 866 700 | A3 | 8/2005 |
| GB | 19000202 | | 8/1910 |
| GB | 191014385 | | 4/1911 |
| GB | 191300373 | | 3/1913 |

| | | | |
|---|---|---|---|
| GB | 191501589 | | 7/1915 |
| GB | 393195 | | 6/1933 |
| GB | 472469 | | 9/1937 |
| GB | 474685 | | 11/1937 |
| GB | 604116 | | 6/1948 |
| GB | 608354 | | 9/1948 |
| GB | 615019 | | 12/1948 |
| GB | 1055817 | | 1/1967 |
| GB | 1128112 | | 9/1968 |
| GB | 1120303 | | 10/1968 |
| GB | 1 308 375 | | 2/1973 |
| GB | 1 582 091 | | 12/1980 |
| JP | 57-127797 | | 8/1982 |
| JP | 61-24999 | | 2/1986 |
| RU | 2 164 334 | C1 | 3/2001 |
| RU | 2 237 839 | C1 | 10/2004 |
| WO | 03098144 | A1 | 11/2003 |
| WO | 2005121686 | A2 | 12/2005 |
| WO | 2008014984 | A1 | 2/2008 |
| WO | 2008108786 | A2 | 9/2008 |

* cited by examiner

PRESSURE-REGULATING GAS BLOCK

CROSS-REFERENCE TO RELATED APPLICATIONS

The present patent application is a continuation-in-part patent application and claims priority from U.S. Provisional Patent Application Ser. No. 61/147,702, filed Jan. 27, 2009, entitled "Pressure-Regulating Gas Block," and to PCT Patent Application No. PCT/US2010/022293, filed Jan. 27, 2010, entitled "Pressure-Regulated Gas Block," both invented by Bernard T. Windauer, and the disclosures of both being incorporated by reference herein.

BACKGROUND

Military and tactical operations require various ammunition types and various types of semi-automatic and fully automatic firearms. The firearms are also used in both normal and silenced modes of operation. The various types of ammunition develop a wide range of gas pressures when the gunpowder burns. When silencers (sound suppressors) are used, they create a back pressure within the operating system of the firearm. The ambient temperatures in which the firearms are used also create a variation in the pressures within the firearm as the firearm is operated. Given all the conditions that cause variations in the pressures within the firearm, there are a seemingly infinite number of pressure variations that can occur. When a firearm is designed, the average working conditions are determined in view of expected variations in pressure within the firearm and stresses and construction material strengths calculated.

When a firearm is used in a semi-automatic mode without a silencer or in an automatic mode without a silencer, the speed of operation (cyclic rate) of the firearm is not a factor considered to affect a soldier's safety although the sound signature is considered to be a significant factor that adversely affect a soldier's safety due to alerting the enemy to the soldier's position. When a firearm is are used in the semi-automatic mode with a silencer, the cyclic rate of the firearm operation is not considered to be a significant factor that adversely affects the soldier's safety because the firearm only fires once per trigger squeeze, however, the sound signature could be a critical (i.e., life and death) factor depending on the ambient conditions. When a firearm is used in the fully-automatic mode with a silencer, the cyclic rate of the firearm operation and the sound signature could be a critical (i.e., life and death) factor to the soldier's safety depending on ambient conditions. A problem that has existed since the advent of gas-operated firearms that are used with silencers has been the increase in cyclic rate due to the increased backpressure created by the silencer installed on the end of the barrel. The cyclic rate increase due to the additional back pressure adds additional stresses to the firearm beyond the designed average working conditions causing material failures and ammunition-loading failures as well as an increased sound signature, both of which may compromise the safety of a soldier using the firearm.

Another problem that exists is the increase in cyclic rate of the firearm used in the semi-automatic and fully-automatic modes, which occurs when the ammunition type changes for a given firearm. Different ammunition types develop different operating pressures. Firearm operating temperatures based on duration of operation and ambient temperatures also affect operating temperatures. A difference in operating pressure above the pressure for which the firearm was designed increases in cyclic rate of the firearm, which causes excessive stresses on the operating parts of the firearm, and may cause breakage of the operating parts and/or ammunition-loading failures. The problems caused by greater-than-design pressures and/or increase in cyclic rate and sound signature (when used with a silencer) can result in creating a life and death situation for a soldier and/or the soldier's team members.

BRIEF DESCRIPTION OF THE DRAWINGS

The subject matter disclosed herein is illustrated by way of example and not by limitation in the accompanying figures in which like reference numerals indicate similar elements and in which.

DETAILED DESCRIPTION

It should be understood that the word "exemplary," as used herein, means "serving as an example, instance, or illustration." Any embodiment described herein as "exemplary" is not to be construed as necessarily preferred or advantageous over other embodiments.

Figure 1A:
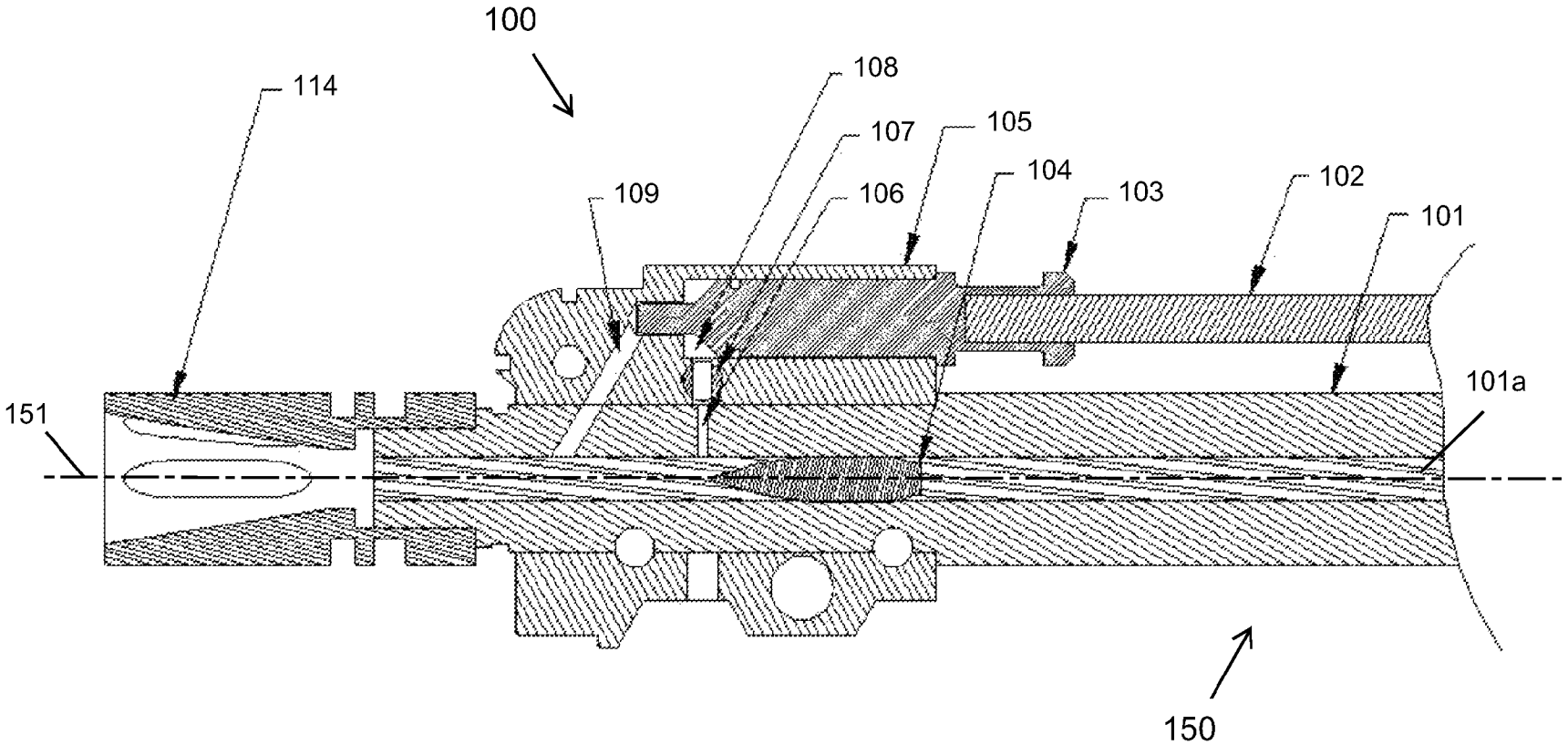
FIG. 1A depicts a cross-sectional view of a first exemplary embodiment of a Pressure-Regulating Firearm Gas Block (PRFGB) and a firearm through the barrel of the firearm along a longitudinal axis with a bullet approaching a first gas port.
Figure 1B:
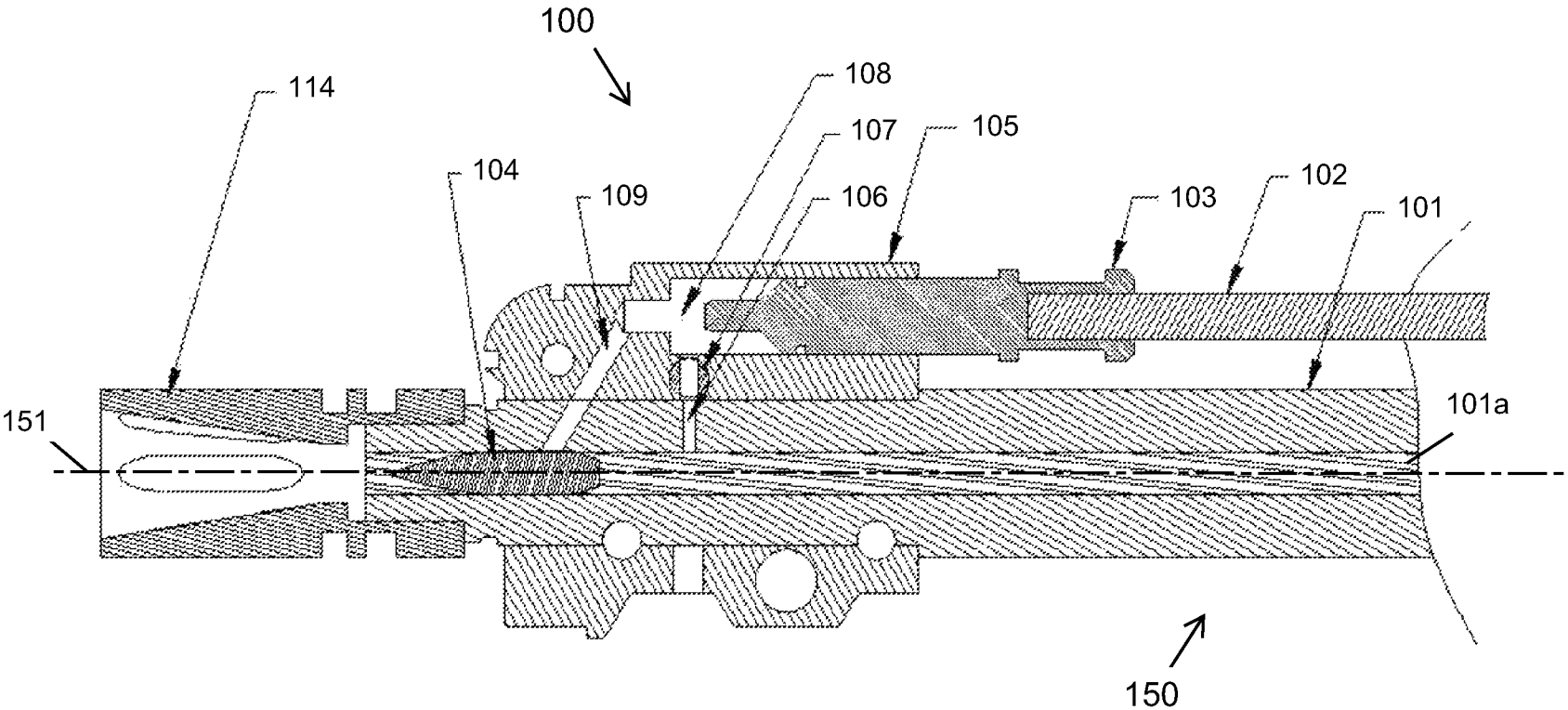
FIG. 1B depicts a cross-sectional view of the first exemplary embodiment of a PRFGB and a firearm through the barrel of the firearm along a longitudinal axis with the bullet passing the first gas port.
Figure 1C:
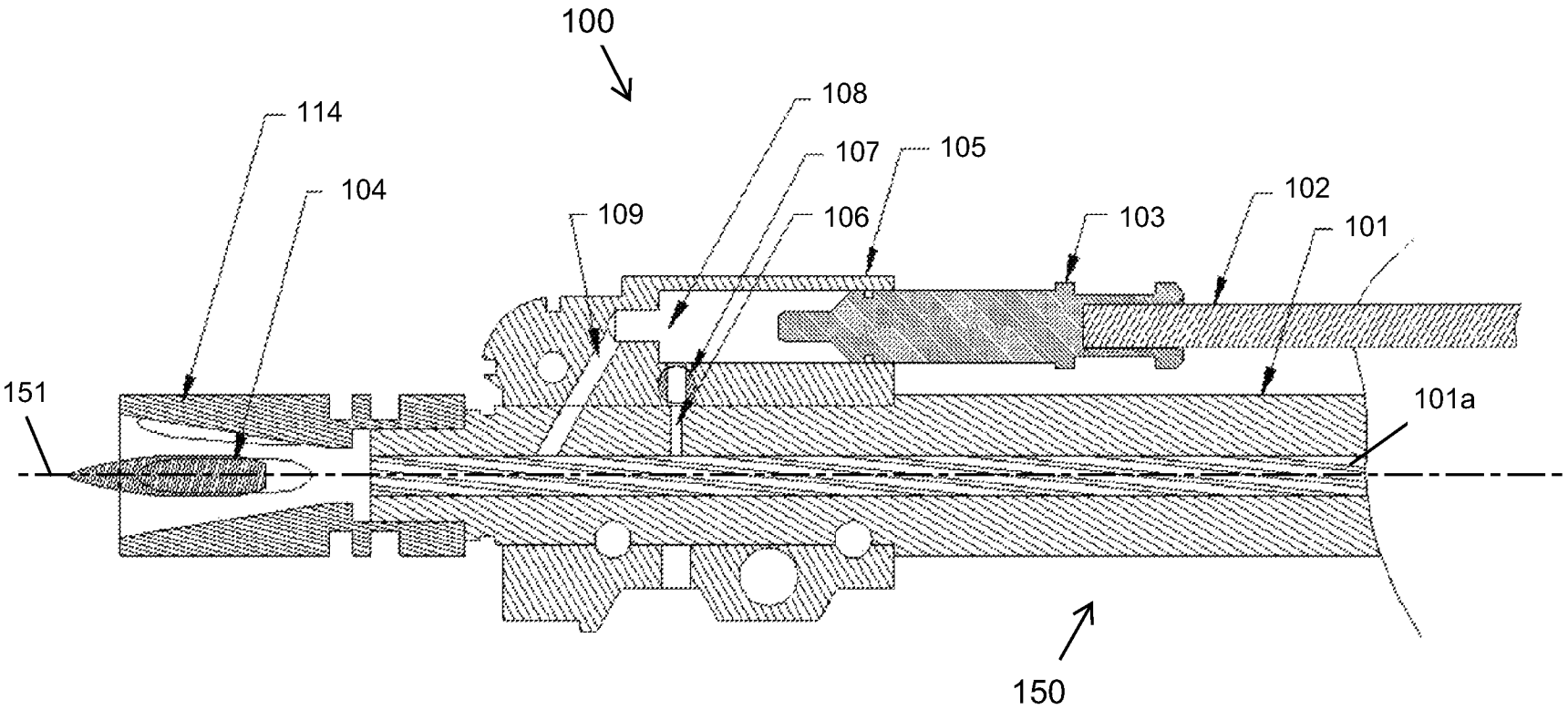
FIG. 1C depicts a cross-sectional view of the first exemplary embodiment of a PRFGB and a firearm through the barrel of the firearm along a longitudinal axis with the bullet exiting the barrel and a flash arrestor/suppressor adapter.

FIGS. 1A-1C respectively show different time periods of operation for a first exemplary embodiment (timing/piston movement) of a Pressure-Regulating Firearm Gas Block (PRFGB) 100 mounted on a "select fire" (i.e., selectably semi-automatic or fully-automatic) firearm 150 according to the subject matter disclosed herein. In particular, FIG. 1A depicts a cross-sectional view of a first exemplary embodiment of the Pressure-Regulating Firearm Gas Block (PRFGB) 100 and a firearm 150 through the barrel 101 of firearm 150 along a longitudinal axis 151 with a bullet 104 approaching a first gas port 106. FIG. 1B depicts a cross-sectional view of the first exemplary embodiment of PRFGB 100 and firearm 150 through barrel 101 of firearm 150 along longitudinal axis 151 with a bullet 104 passing first gas port 106. FIG. 1C depicts a cross-sectional view of the first exemplary embodiment of PRFGB 100 and firearm 150 through barrel 101 of firearm 150 along longitudinal axis 151 with a bullet 104 exiting barrel 101 and a flash arrestor/suppressor adapter 114. It should be understood that only a portion of firearm 150 is depicted in FIGS. 1A-1C. It should also be understood that in one exemplary embodiment, firearm 150 comprises a semi-automatic firearm, a fully automatic firearm, or a combination thereof. Additionally, it should be understood that while PRFGB 100 is depicted as being remote from the mechanical loading and ejection components of firearm 150 (i.e., forward mounted on the barrel of firearm 150), PRFGB 100 could be positioned to be adjacent to (i.e., in relatively close proximity) the mechanical loading and ejection components of firearm 150, or integrally (i.e., within the firearm receiver) to the mechanical loading and ejection components of the firearm.

The first exemplary embodiment of PRFGB 100 depicted in FIGS. 1A-1C is timing based and venting can be directly into the bore of the barrel of the firearm or directly into atmosphere through one or more side-located (not shown), top-located (not shown), or front located (not shown) relief ports according to the subject matter disclosed herein. As depicted in FIGS. 1A-1C, PRFGB 100 comprises a housing 105, an operating piston 103, and a gas shut-off valve 107. Housing 105 forms a gas cylinder 108, which is a pressure chamber that is fluidly coupled to the bore 101*a* of barrel 101 through gas port 106 and gas shut-off valve 107. During operation of firearm 150, a bullet 104 is pushed down the bore 101*a* of a barrel 101 of firearm 150 by expanding high-pressure gas created from the burning of the gunpowder (FIG. 1A).

When bullet 104 passes a first gas port 106 (FIG. 1B), a portion of the high-pressure gas passes through gas port 106, through the gas shut-off value 107 and enters gas cylinder 108. The expanding gas pushes operating piston 103 rearward (to the right in FIGS. 1A-1C) to cycle a firearm operating rod 102 or directly operate the firearm cartridge loading and ejecting mechanical components (bolt/bolt carrier)(not shown) if the piston assembly is located in the receiver of the firearm (not shown). The increasing pressure formed by the expanding gas moves operating piston 103 rearward a certain distance, at which time the pressure reaches a designed pressure peak and the high-pressure gasses are then allowed to enter a relief port 109 and exit housing 105 either into the bore 101*a* of barrel 101, which is depicted in FIGS. 1A-1C, or to the atmosphere through side-, top-, or front-located relief ports in PRFGB housing 105, which are not depicted in FIGS. 1A-1C. Relief port 109 is fluidly coupled between cylinder 108 and the bore 101*a* of barrel 101. Once the interior pressure within gas cylinder 108 has been vented, no additional force is pushing operating piston 103 and operating rod 102 rearward to cycle firearm 150.

Once the rearward movement of the operating rod 102 reaches its physically limited movement (FIG. 1C), a recoil spring (not shown) moves operating rod 102 and operating piston 103 forward into their physically limited position in preparation for the next operating cycle.

Figure 4A:
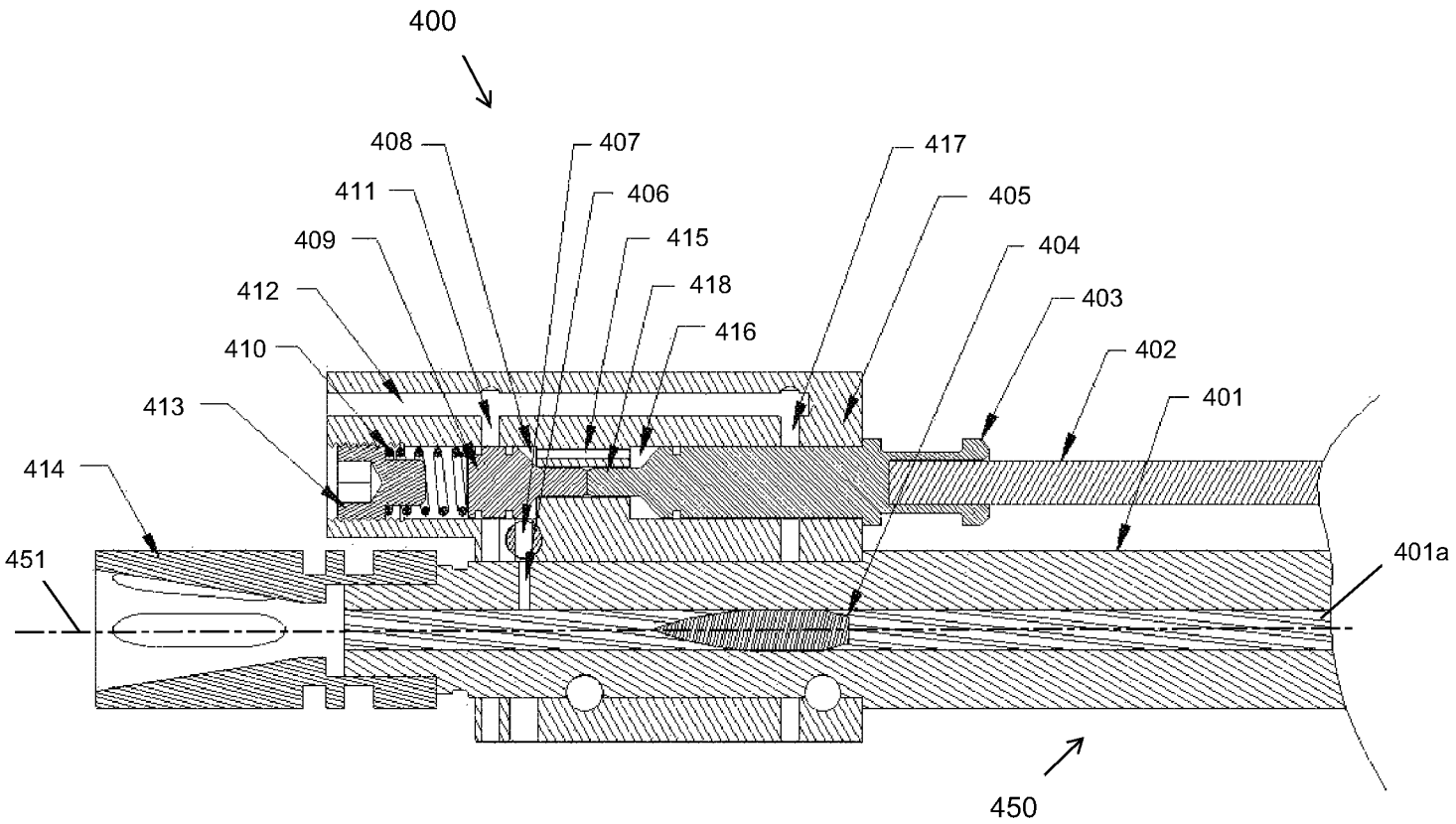
FIG. 4A depicts a fourth exemplary embodiment of a PRFGB and a firearm through the barrel of the firearm along a longitudinal axis with a bullet 404 approaching a gas port.
Figure 4B:
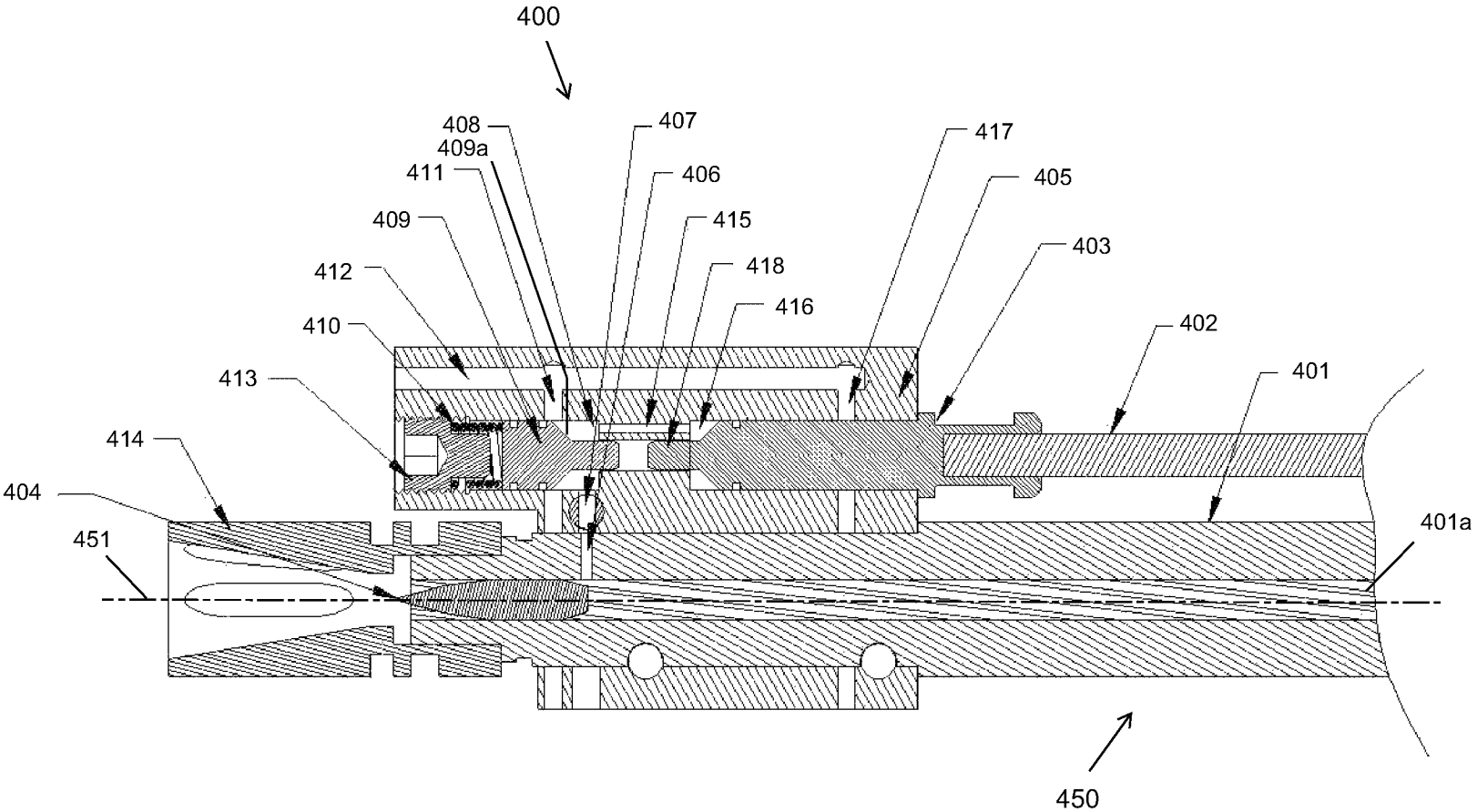
FIG. 4B depicts the fourth exemplary embodiment of a PRFGB and a firearm through the barrel of the firearm along a longitudinal axis with the bullet having passed a gas port as the bullet travels toward the firearm flash arrestor/suppressor adapter.
Figure 4C:
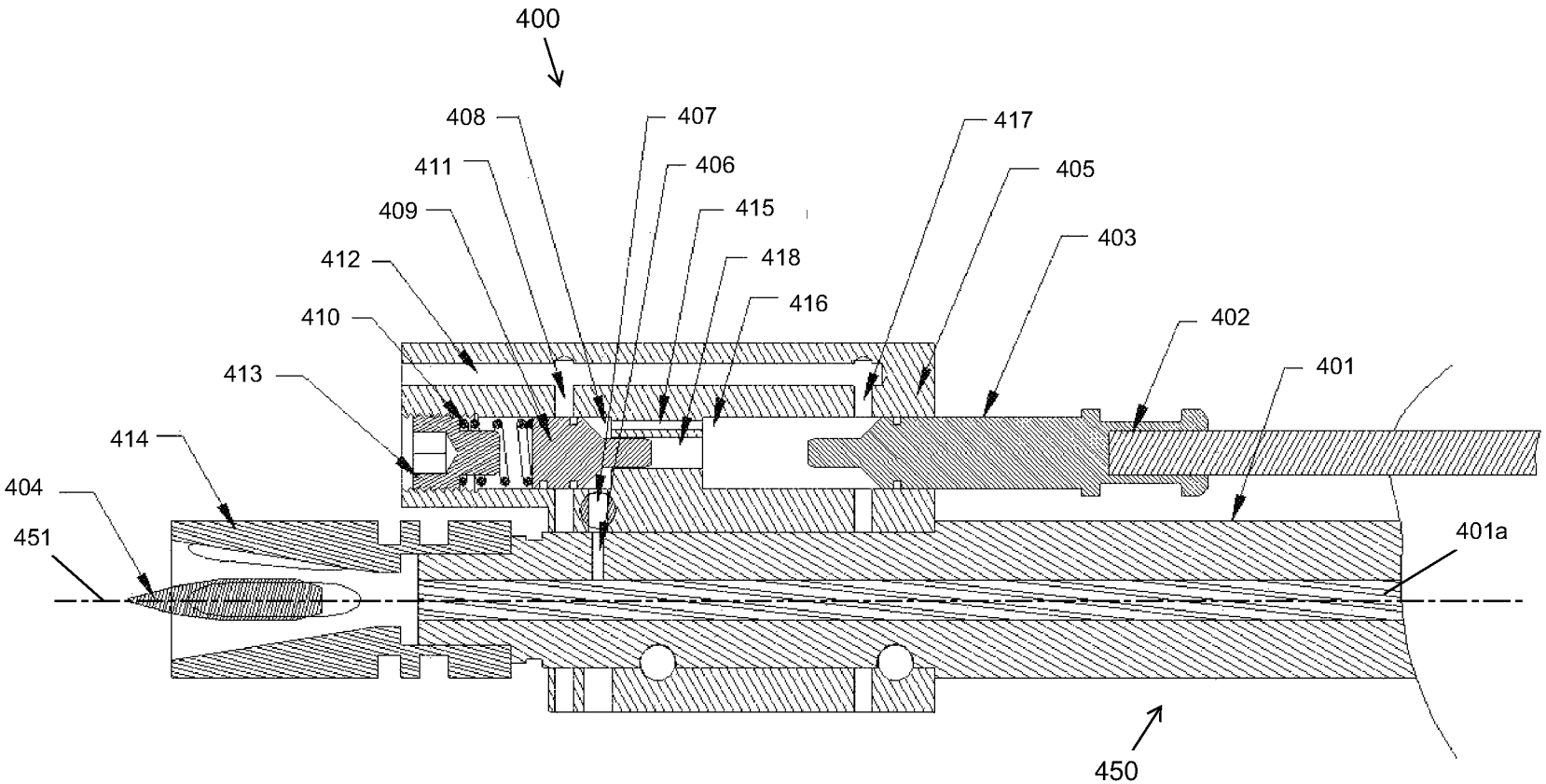
FIG. 4C depicts the fourth exemplary embodiment of a PRFGB and a firearm through the barrel of the firearm along a longitudinal axis with the bullet exiting the barrel and flash arrestor/suppressor adapter.

The specific location of relief port 109 is dependent on design parameters for operator safety based on a visual signature (i.e., flame release) and/or a sound signature (i.e., pop sound of released high-pressure gas) during operation. In a situation in which venting high-pressure gas directly to the exterior of the firearm is not a life-and/or-safety compromising issue, relief portion 109 could be located in one exemplary embodiment on either side, front, or on the top of PRFGB housing 105. In a situation in which venting high-pressure gas directly to the exterior of the firearm is a life-and/or-safety compromising issue, relief port 109 could be located in one exemplary embodiment on the bottom of PRFGB housing 105 (as depicted in FIGS. 1A-1C) to vent directly into the bore 101*a* of barrel 101 of firearm 150. By design, the relative speed of the bullet compared to the speed of the gas and operating parts of PRFGB 100 eliminate the possibility of gas flowing backwards through relief port 109 into PRFGB 100. In a situation in which venting high-pressure gas directly to the exterior of the firearm is a life-and/or-safety compromising issue, relief port 109 could be located in one exemplary embodiment on the front of PRFGB housing 105 (as depicted in FIGS. 4A-4C) to vent directly into the rear of a silencer (not shown) mounted on the barrel 101 of firearm 150.

Figure 2A:
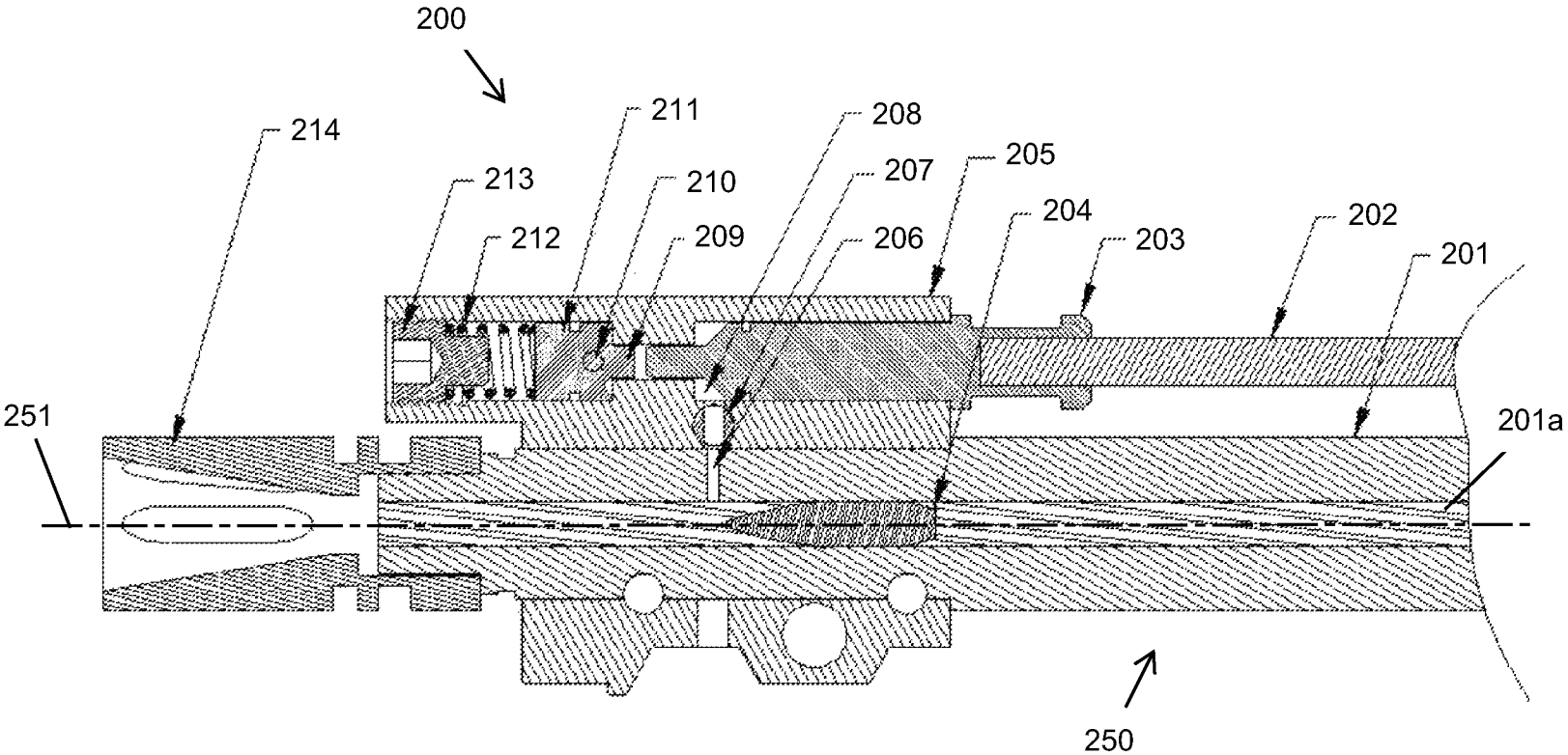
FIG. 2A depicts a second exemplary embodiment of a PRFGB and a firearm through the barrel of the firearm along a longitudinal axis with a bullet approaching a first gas port.
Figure 2B:
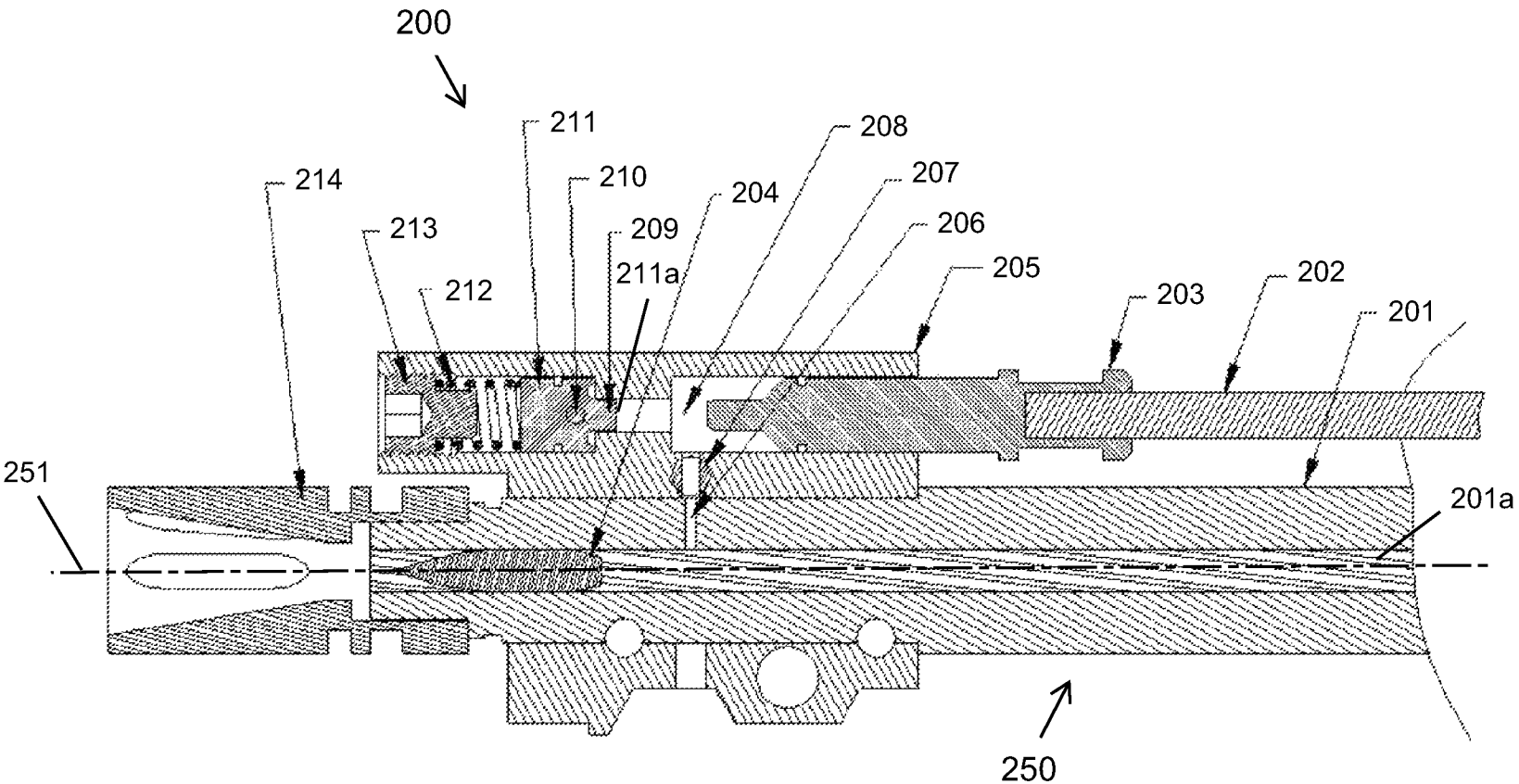
FIG. 2B depicts the second exemplary embodiment of a PRFGB and a firearm through the barrel of the firearm along a longitudinal axis with the bullet having passed the first gas port and blocking a second gas port as the bullet travels toward the firearm flash arrestor/suppressor adapter.
Figure 2C:
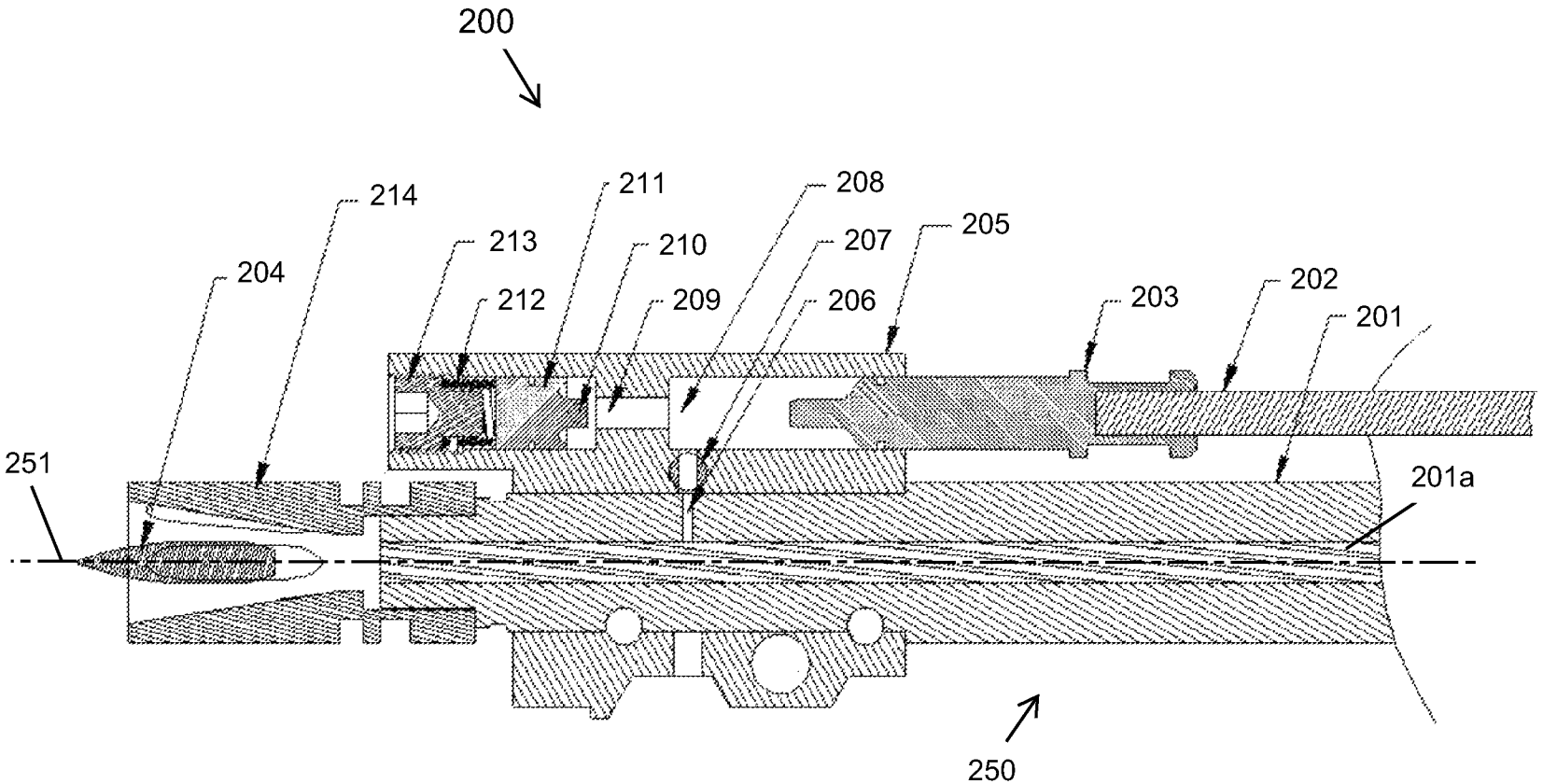
FIG. 2C depicts the second exemplary embodiment of a PRFGB and a firearm through the barrel of the firearm along a longitudinal axis with the bullet exiting the barrel and flash arrestor/suppressor adapter.

FIGS. 2A-2C respectively show different time periods of operation of a second exemplary embodiment of the Pressure-Regulating Firearm Gas Block (PRFGB) mounted on a "select fire" (i.e., selectably semi-automatic or fully-automatic) firearm according to the subject matter disclosed herein. More specifically, FIG. 2A depicts a second exemplary embodiment of a PRFGB 200 and a firearm 250 through the barrel 201 along a longitudinal axis 251 of the firearm with a bullet 104 approaching a first gas port 206. FIG. 2B depicts the second exemplary embodiment of PRFGB 200 and a firearm 250 through the barrel 201 of the firearm along a longitudinal axis 251 with bullet 204 having passed first gas port 206 and blocking a second gas port 210 as bullet 204 travels toward the firearm flash arrestor/suppressor adapter 214 FIG. 2C depicts the second exemplary embodiment of PRFGB 200 and a firearm 250 through the barrel 201 of firearm 250 along longitudinal axis 251 with bullet 204 exiting the barrel 201 and flash arrestor/suppressor adapter 214. It should be understood that only a portion of firearm 250 is depicted in FIGS. 2A-2C. It should also be understood that in one exemplary embodiment, firearm 250 comprises a semi-automatic firearm, a fully automatic firearm, or a combination thereof. Additionally, it should be understood that while PRFGB 200 is depicted as being remote from the mechanical loading and ejection components of firearm 250 (i.e., forward mounted on the barrel of firearm 250), PRFGB 200 could be positioned to be adjacent to (i.e., in relatively close proximity) the mechanical loading and ejection components of firearm 250, or integrally (i.e., within the firearm receiver) to the mechanical loading and ejection components of the firearm.

The second exemplary embodiment of PRFGB 200 depicted in FIGS. 2A-2C is pressure based and venting is shown to be directly to atmosphere through side-, top-, or front-located relief ports of the PRFGB housing according to the subject matter disclosed herein. As depicted in FIGS. 2A-2C, PRFGB 200 comprises a housing 205, an operating piston 203, a gas shut-off valve 207, and a pressure relief mechanism comprising a relief piston 211, a relief piston spring 212, and a relief piston spring adjustment screw 213. Housing 205 forms a gas cylinder 208, which is a pressure chamber that is fluidly coupled to the bore 201*a* of barrel 201 through gas port 206 and gas shut-off valve 207. During operation of firearm 250, a bullet 204 is pushed down the bore 201*a* of the barrel 201 of the firearm by expanding high-pressure gas created from the burning of the gunpowder (FIG. 2A).

When bullet 204 passes first gas port 206 (FIG. 2B), a portion of the high-pressure gas passes through the first gas port 206, through the gas shut-off valve 207 and enters the a gas cylinder 208. The expanding gas pushes the operating piston 203 rearward (to the right in FIGS. 2A-2C) to cycle a firearm operating rod 202 or directly operate the firearm cartridge loading and ejecting mechanical components (bolt/bolt carrier)(not shown) if the piston assembly is located in the receiver of the firearm (not shown).

The increasing pressure formed by the expanding gas moves operating piston 203 rearward a certain distance, at which time the pressure reaches a designed pressure peak and the high-pressure gasses are then allowed to enter a transfer port 209 and impinge on the face of the relief piston 211, which is part of the pressure relief mechanism. If the force of the gas pressure within the transfer port 209 pushing on the face 211*a* (FIG. 2B) of the relief piston 211 is less than the reacting force exerted by the relief piston spring 212 on relief piston 211, no gas pressure will be relieved through relief port 210 (located on the front, side, or top of PRFGB housing 205), which is fluidly coupled between gas cylinder 208 and the bore 201*a* of barrel 201. If the force of the gas pressure within transfer port 209 pushing on the face 211*a* of relief piston 211 is greater than the reacting force exerted by relief piston spring 212 on relief piston 211, gas pressure will be relieved through relief portion 210. The pressure at which gas is vented through the system can be adjusted by operation of relief piston spring adjustment screw 213. In one exemplary embodiment, screwing in (i.e., clockwise) on relief piston spring adjustment screw 213 increases compressive force on relief piston spring 212 and relief piston 211, thereby increasing the gas pressure required to move relief piston 211 to vent the high-pressure gas. In one exemplary embodiment, screwing out (i.e., counter-clockwise) on relief piston spring adjustment screw 213 decreases the compressive force on relief piston spring 212 and relief piston 211, thereby decreasing the gas pressure required to move relief piston 211 in order to vent the high-pressure gas. In another exemplary embodiment, rotation direction of the adjustment can be reversed depending on design. In a situation in which venting high-pressure gas directly to the exterior of the firearm is not a life-and/or-safety compromising issue, relief portion 210 could be located in one exemplary embodiment on the side, front, or top of PRFGB housing 205.

Once the rearward movement of the operating rod 202 reaches its physically limited movement (FIG. 2C), a recoil spring (not shown) moves operating rod 202 and operating piston 203 forward into their physically limited position in preparation for the next operating cycle.

Figure 3A:
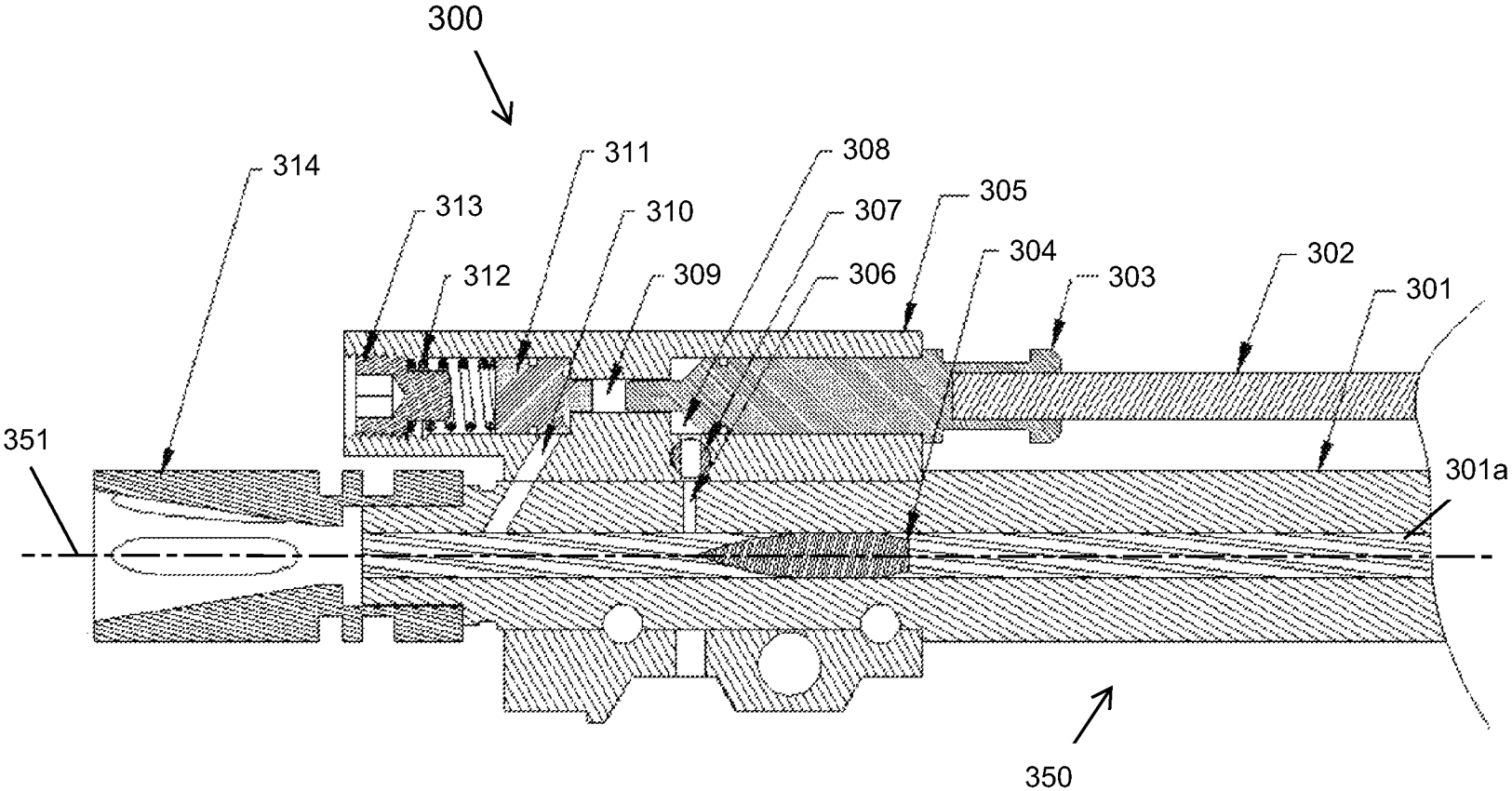
FIG. 3A depicts a third exemplary embodiment of a PRFGB and a firearm through the barrel of the firearm along a longitudinal axis with a bullet approaching a first gas port.
Figure 3B:
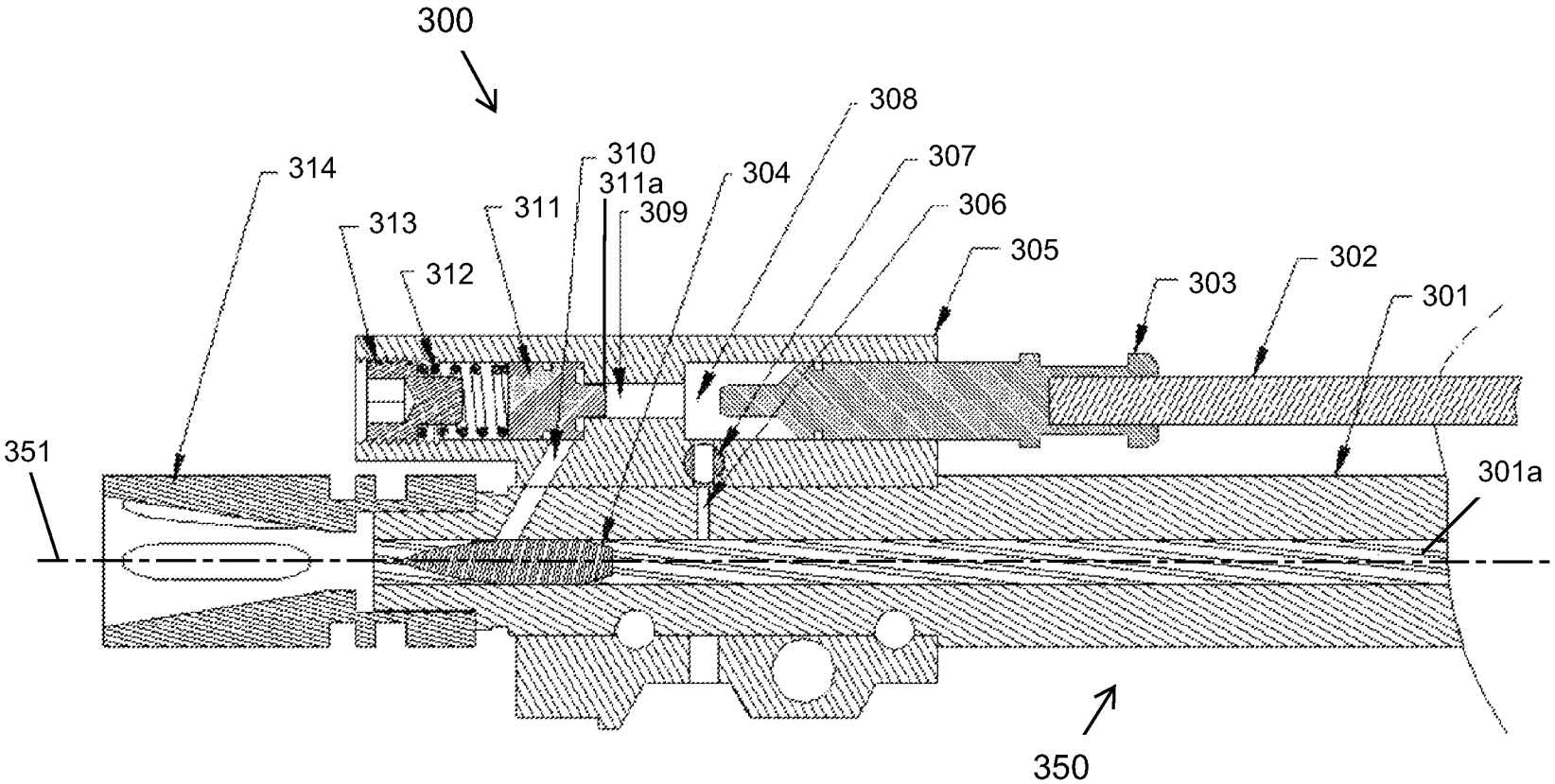
FIG. 3B depicts the third exemplary embodiment of a PRFGB and a firearm through the barrel of the firearm along a longitudinal axis with the bullet having passed the first gas port and blocking a second gas port as the bullet travels toward the firearm flash arrestor/suppressor adapter.
Figure 3C:
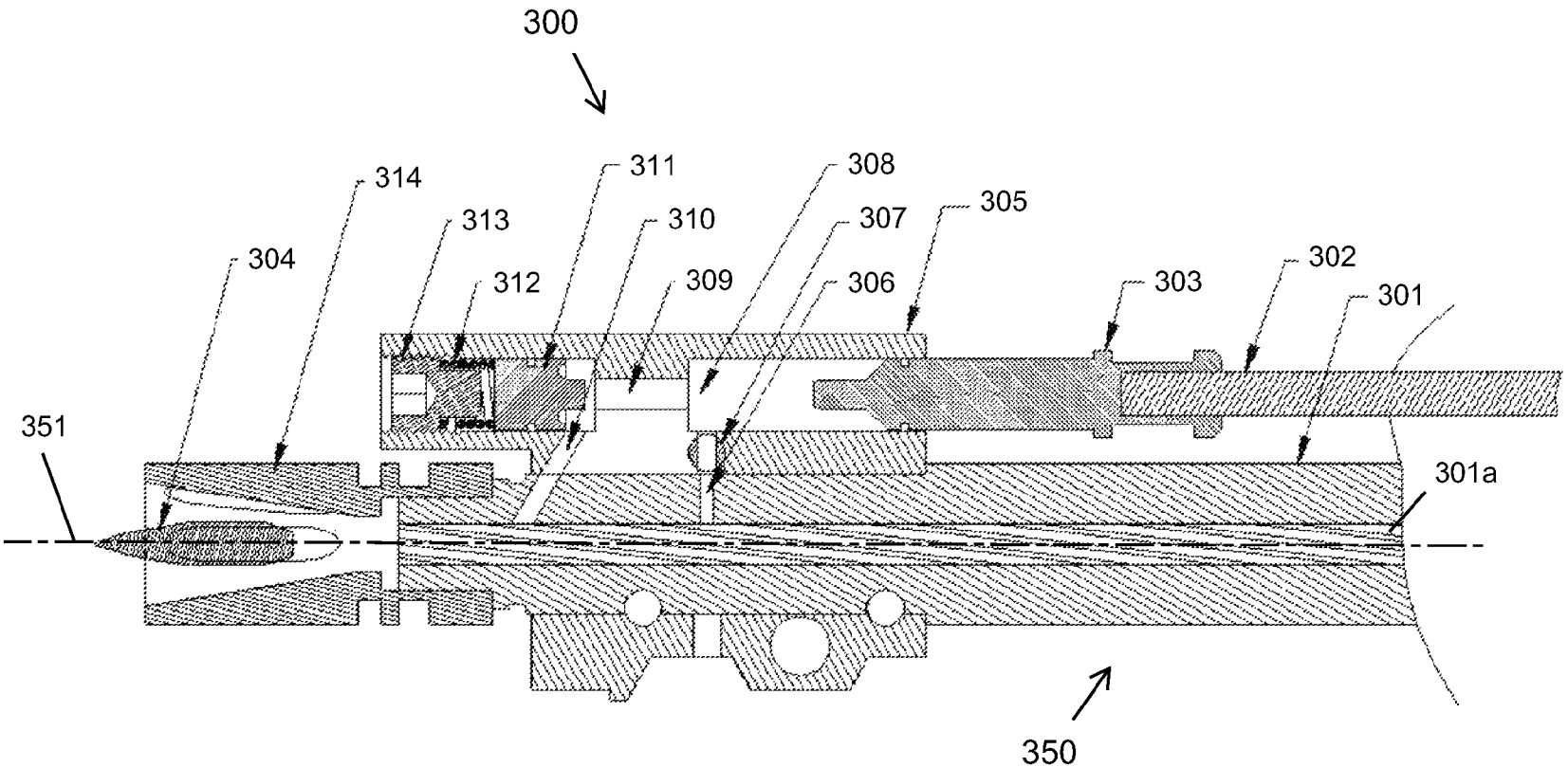
FIG. 3C depicts the third exemplary embodiment of a PRFGB and a firearm through the barrel of the firearm along a longitudinal axis with the bullet exiting the barrel and flash arrestor/suppressor adapter.

FIGS. 3A-3C respectively show different time periods of operation of a third exemplary embodiment of the Pressure-Regulating Firearm Gas Block (PRFGB) mounted on a "select fire" (i.e., selectably semi-automatic or fully-automatic) firearm according to the subject matter disclosed herein. In particular, FIG. 3A depicts a third exemplary embodiment of a PRFGB 300 and a firearm 350 through the barrel 301 of firearm 350 along a longitudinal axis 351 with a bullet 304 approaching a first gas port 306. FIG. 3B depicts the third exemplary embodiment of a PRFGB 300 and a firearm 350 through the barrel 301 of firearm 350 along a longitudinal axis 351 with bullet 304 having passed first gas port 306 and blocking a second gas port 310 as the bullet travels toward the firearm flash arrestor/suppressor adapter 314. FIG. 3C depicts the third exemplary embodiment of a PRFGB 300 and a firearm 350 through the barrel 301 of firearm 350 along a longitudinal axis 351 with bullet 304 exiting barrel 301 and flash arrestor/suppressor adapter 314. It should be understood that only a portion of firearm 350 is depicted in FIGS. 3A-3C. It should also be understood that in one exemplary embodiment, firearm 350 comprises a semi-automatic firearm, a fully automatic firearm, or a combination thereof. Additionally, it should be understood that while PRFGB 300 is depicted as being remote from the mechanical loading and ejection components of firearm 350 (i.e., forward mounted on the barrel of firearm 350), PRFGB 300 could be positioned to be adjacent to (i.e., in relatively close proximity) the mechanical loading and ejection components of firearm 350, or integrally (i.e., within the firearm receiver) to the mechanical loading and ejection components of the firearm.

The third exemplary embodiment of PRFGB 300 is pressure based and venting is depicted to be directly into the barrel of the firearm through a bottom-located relief port of the PRFGB housing according to the subject matter disclosed herein. As depicted in FIGS. 3A-3C, PRFGB 300 comprises a housing 305, an operating piston 303, a gas shut-off valve 307, and a pressure relief mechanism comprising a relief piston 311, a relief piston spring 312, and a relief piston spring adjustment screw 313. Housing 305 forms a gas cylinder 308, which is a pressure chamber that is fluidly coupled to the bore 301*a* of barrel 301 through gas port 306 and gas shut-off valve 307. During operation of firearm 350, a bullet 304 is pushed down the barrel 301 of the firearm by expanding high-pressure gas created from the burning of the gunpowder (FIG. 3A).

When bullet 304 passes a first gas port 306, a portion of the high-pressure gas passes through gas port 306, through gas shut-off valve 307 and enters a gas cylinder 308. The expanding gas pushes operating piston 303 rearward (to the right in FIGS. 3A-3C) to cycle firearm operating rod 302 or directly operate the firearm cartridge loading and ejecting mechanical components (bolt/bolt carrier)(not shown) if the piston assembly is located in the receiver of the firearm (not shown) which, in turn, cycles the firearm operating system.

The increasing pressure formed by the expanding gas moves operating piston 303 rearward a certain distance, at which time the pressure peaks at a designed pressure peak and the high-pressure gasses are then allowed to enter a transfer port 309 and impinge on the face 311*a* (FIG. 3B) of relief piston 311, which is part of the pressure relief mechanism. If the force of the gas pressure within transfer port 309 pushing on the face 311*a* of relief piston 311 is less than the reacting force exerted by relief piston spring 312 on relief piston 311, no gas pressure will be relieved through relief port 310, which is fluidly coupled between gas cylinder 308 and the bore 301*a* of barrel 301. If the force of the gas pressure within transfer port 309 pushing on the face 311*a* of relief piston 311 is greater than the reacting force exerted by relief piston spring 312 on relief piston 311, gas pressure will be relieved through relief port 310. The pressure at which gas is vented through the system can be adjusted by operation of relief piston spring adjustment screw 313. In one exemplary embodiment, screwing in (i.e., clockwise) on relief piston spring adjustment screw 313 increases compressive force on relief piston spring 312 and relief piston 311, thereby increasing the gas pressure required to move relief piston 311 to vent the high-pressure gas. In one exemplary embodiment, screwing out (i.e., counter-clockwise) on relief piston spring adjustment screw 313 decreases the compressive force on relief piston spring 312 and relief piston 311, thereby decreasing the gas pressure required to move relief piston 311 to vent the high-pressure gas. In another exemplary embodiment, rotation direction adjustment can be reversed dependent on design.

Once the rearward movement of the operating rod 302 reaches its physically limited movement (FIG. 3C), a recoil spring (not shown) moves operating rod 302 and operating piston 303 forward into their physically limited position in preparation for the next operating cycle.

Due to the speed of bullet 304 relative to the speed of the high-pressure gas flowing through the system and amount of time required for the movement of operating piston 303, operating rod 302, and relief piston 311, bullet 304 will have passed relief port 310 before relief piston 311 opens. The relative speed of bullet 304 compared to the speed of the gas and operating parts eliminates the possibility of gas flowing backwards through the system through relief port 310.

The third exemplary embodiment (relief venting into the barrel) eliminates the visual and sound signatures of venting the relief gasses to atmosphere through the side or top of the PRFGB housing 305 during use of the firearm with a sound suppressor. During the use of firearms with suppressors due the efficiency of some modern firearm suppressors and ammunition, the operation of the mechanical components of the firearm makes more noise than the firing of the firearm. In a situation in which a soldier desires the lowest sound signature possible, gas shut-off valve 307 can be closed by inserting the tip (of a bullet) of a loaded cartridge into a protruding lever handle machined on the end of the rotating (circular) portion of the gas shut off valve 307 thereby stopping the semi-automatic or fully-automatic operation of the firearm. In this manner, the soldier needs no special tools or devices to close off the valve other than the ammunition he/she is using to fire the firearm. The firearm must then be manually cycled at a time when the soldier deems appropriate.

FIGS. 4A-4C respectively show different time periods of operation of a fourth exemplary embodiment of the Pressure-Regulating Firearm Gas Block (PRFGB) mounted on a "select fire" (i.e., selectably semi-automatic or fully-automatic) firearm according to the subject matter disclosed herein. In particular, FIG. 4A depicts a fourth exemplary embodiment of a PRFGB 400 and a firearm 450 through the barrel 401 of firearm 450 along a longitudinal axis 451 with a bullet 404 approaching a first gas port 406. FIG. 4B depicts the fourth exemplary embodiment of a PRFGB 400 and a firearm 450 through the barrel 401 of firearm 450 along a longitudinal axis 451 with bullet 404 having passed first gas port 406 as the bullet travels toward the firearm flash arrestor/suppressor adapter 414. FIG. 4C depicts the fourth exemplary embodiment of a PRFGB 400 and a firearm 450 through the barrel 401 of firearm 450 along a longitudinal axis 451 with bullet 404 exiting barrel 401 and flash arrestor/suppressor adapter 414. It should be understood that only a portion of firearm 450 is depicted in FIGS. 4A-4C. It should also be understood that in one exemplary embodiment, firearm 450 comprises a semi-automatic firearm, a fully automatic firearm, or a combination thereof. Additionally, it should be understood that while PRFGB 400 is depicted as being remote from the mechanical loading and ejection components of firearm 450 (i.e., forward mounted on the barrel of firearm 450), PRFGB 400 could be positioned to be adjacent to (i.e., in relatively close proximity) the mechanical loading and ejection components of firearm 450, or integrally (i.e., within the firearm receiver) to the mechanical loading and ejection components of the firearm.

The fourth exemplary embodiment of PRFGB 400 is pressure based and venting is depicted to be directly into a suppressor (silencer)(not shown) mounted to the forward portion of the barrel 401 of the firearm through the front relief port 412 of the PRFGB housing 405 according to the subject matter disclosed herein. As depicted in FIGS. 4A-4C, PRFGB 400 comprises a housing 405, an operating piston 403, a gas shut-off valve 407, and a pressure relief mechanism comprising a relief piston 409, a relief piston spring 410, and a relief piston spring adjustment screw 413. Housing 405 forms two gas cylinders 408 and 416 of which cylinder 408 is a pressure chamber that is fluidly coupled to the bore 401*a* of barrel 401 through gas port 406 and gas shut-off valve 407. During operation of firearm 450, a bullet 404 is pushed down the barrel 401 of the firearm by expanding high-pressure gas created from the burning of the gunpowder (FIG. 4A).

When bullet 404 passes gas port 406, a portion of the high-pressure gas passes through gas port 406, through gas shut-off valve 407 and enters a gas cylinder 408. If the force of the gas pressure within gas cylinder 408 pushing on the face 409*a* (FIG. 4B) of relief piston 409 is greater than the reacting force exerted by relief piston spring 410 on relief piston 409, the relief piston 409 will move forward and compress the relief piston spring 410 so that gas pressure will be relieved through relief port 411 and 412. In one exemplary embodiment, port 412 is capable of being fluidly coupled to a sound suppressor. The pressure at which gas is vented through the system can be adjusted by operation of relief piston spring adjustment screw 413. During the time pressure is being vented (if pressures are greater than the preset pressure) a certain amount of gas is flowing through transfer port 415 into gas cylinder 416. When the pressure in gas cylinder 408 drops to equal the preset pressure of the relief piston 409 and mating relief piston spring 410, the relief piston moves rearward to seal off relief port 411 stopping the venting of gas pressure. Gas pressure continues to flow through transfer port 415 thereby increasing pressure in gas cylinder 416 to move the operating piston 403 rearward which in turn creates a rearward movement of the operating rod 402 to cycle the firearm loading and ejection mechanisms. Upon full stroke (rearward movement limit) the gas pressure in gas cylinder 416 is vented through relief port 417 which allows the forward movement of operating piston 403 and operating rod 402 under spring pressure to return to the forward limit against PRFGB housing 405.

Conversely, when bullet 404 passes gas port 406, a portion of the high-pressure gas passes through gas port 406, through gas shut-off valve 407 and enters a gas cylinder 408. If the force of the gas pressure within gas cylinder 408 pushing on the face 409*a* of relief piston 409 is less than the reacting force exerted by relief piston spring 410 on relief piston 409, the relief piston 409 will not move to open up relief port 411 and gas pressure will not be relieved through relief port 411 and 412. Gas will then flow through transfer port 415 into gas cylinder 416. The increasing pressure formed by the expanding gas moves the operating piston 403 rearward which in turn creates a rearward movement of the operating rod 402 to cycle the firearm loading and ejection mechanisms or directly operate the firearm cartridge loading and ejecting mechanical components (bolt/bolt carrier) (not shown) if the piston assembly is located in the receiver of the firearm (not shown) which, in turn, cycles the firearm operating system.

In one exemplary embodiment, screwing in (i.e., clockwise) on relief piston spring adjustment screw 413 increases compressive force on relief piston spring 410 and relief piston 409, thereby increasing the gas pressure required to move relief piston 409 to vent the high-pressure gas. In one exemplary embodiment, screwing out (i.e., counter-clockwise) on relief piston spring adjustment screw 413 decreases the compressive force on relief piston spring 410 and relief piston 409, thereby decreasing the gas pressure required to move relief piston 409 to vent the high-pressure gas. In another exemplary embodiment, rotation direction adjustment can be reversed dependent on design.

Once the rearward movement of the operating rod 402 reaches its physically limited movement (FIG. 4C), a recoil spring (not shown) moves operating rod 402 and operating piston 303 forward into their physically limited position in preparation for the next operating cycle.

The fourth exemplary embodiment (relief venting into the suppressor) eliminates the visual and sound signatures of venting the relief gasses to atmosphere through the side or top of the PRFGB housing 405 during use of the firearm with a sound suppressor. During the use of firearms with suppressors due the efficiency of some modern firearm suppressors and ammunition, the operation of the mechanical components of the firearm makes more noise than the firing of the firearm. In a situation in which a soldier desires the lowest sound signature possible, gas shut-off valve 407 can be closed by inserting the tip (of a bullet) of a loaded cartridge into a protruding lever handle machined on the end of the rotating (circular) portion of the gas shut off valve 407 thereby stopping the semi-automatic or fully-automatic operation of the firearm. In this manner, the soldier needs no special tools or devices to close off the valve other than the ammunition he/she is using to fire the firearm. The firearm must then be manually cycled at a time when the soldier deems appropriate.

Figure 5:
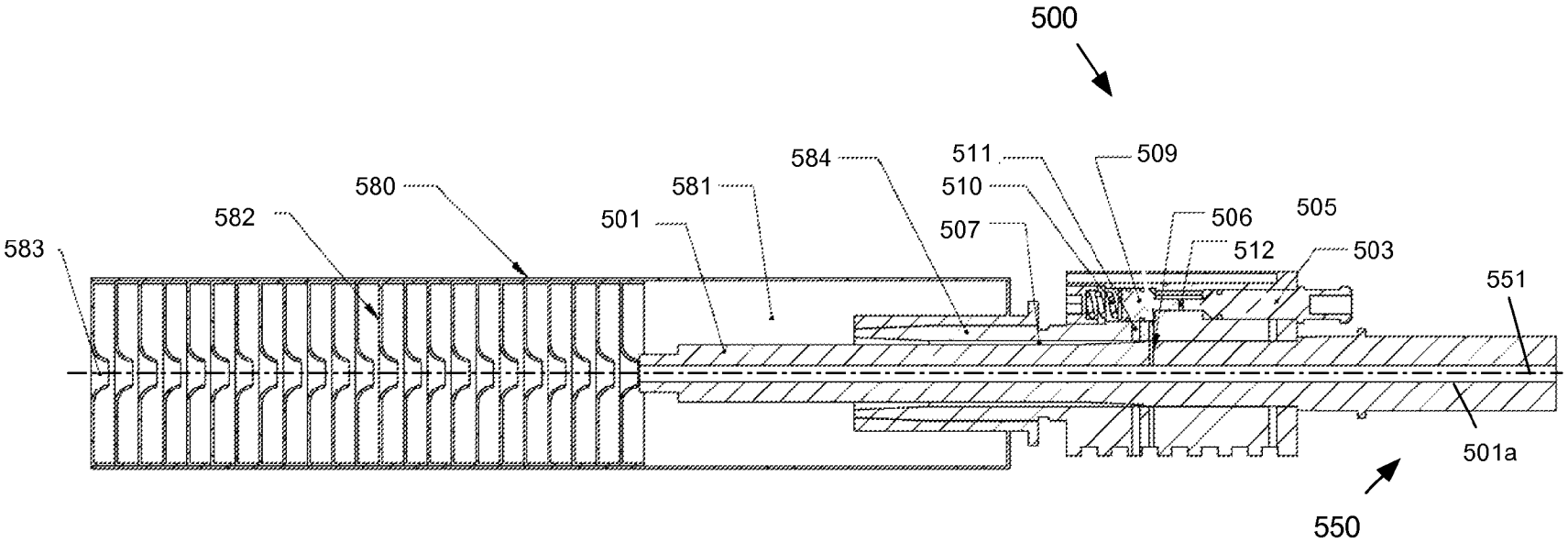
FIG. 5 depicts a cross-sectional side view of a fifth exemplary embodiment of a PRFGB, a firearm through the barrel of the firearm along a longitudinal axis, and a suppressor according to the subject matter disclosed herein.

FIG. 5 depicts a cross-sectional side view of a fifth exemplary embodiment of a PRFGB 500, a firearm 550 through the barrel 501 of the firearm along a longitudinal axis 551, and a suppressor 580 according to the subject matter disclosed herein. It should be understood that only a portion of firearm 550 is depicted in FIG. 5. It should also be understood that in one exemplary embodiment, firearm 550 comprises a semi-automatic firearm, a fully automatic firearm, or a combination thereof. It should also be understood that PRFGB 500 operates substantially in accordance with the other exemplary embodiments disclosed herein. Suppressor 580 is coupled directly to PRFGB 500.

During operation of firearm 550, a bullet (not shown) is pushed down the bore 501*a* of a barrel 501 of firearm 550 by expanding high-pressure gas created from the burning of the gunpowder. When the bullet passes gas port 506, a portion of the high-pressure gas passes through gas port 506 and enters a gas cylinder bringing gas to the rear face of a relief piston 509. The expanding gas also pushes operating piston 503 rearward (toward the right in FIG. 5) to cycle a firearm operating rod (not shown) or directly operate the firearm cartridge loading and ejecting mechanical components (bolt/bolt carrier)(not shown) if the piston assembly is located in the receiver of the firearm (not shown).

When the bullet passes gas port 506, a portion of the high-pressure gas passes through gas port 506 and forces relief piston 509 back against the relief spring 510. When the forces generated by the high-pressure gas on the rear face of relief piston 510 are balanced by the adjustable force of relief spring 510, the desired gas pressure is allowed to flow through a transfer port 512. The pressure cycles operating piston 503 rearward to operate the firearm action. If operating pressures are greater than the set pressure of relief spring 510 and piston assembly 503, the excess pressure is vented through relief port 511 into a vent annulus 507 between barrel 501 and a suppressor mounting tube 584 and directed into a rear chamber 581 of sound suppressor 580. The excess pressure is then vented through sound suppressor baffles 582 and to atmosphere through the sound suppressor muzzle 583.

In an alternative exemplary embodiment, the PRFGB comprises a relief aperture on the front face of the PRFGB from which excess pressure is vented into a directly coupled aperture of a sound suppressor. When the suppressor is affixed to the gas block the vent hole of the gas block aligns with the vent inlet of the sound suppressor. In yet another alternative exemplary embodiment, the PRFGB comprises a relief aperture that is capable of venting excess pressure into the bore of the firearm and/or into a suppressor.

Although the foregoing disclosed subject matter has been described in some detail for purposes of clarity of understanding, it will be apparent that certain changes and modifications may be practiced that are within the scope of the appended claims. Accordingly, the present embodiments are to be considered as illustrative and not restrictive, and the subject matter disclosed herein is not to be limited to the details given herein, but may be modified within the scope and equivalents of the appended claims.

What is claimed is:

1. A gas block assembly for a firearm, comprising:

a gas cylinder defining a pressure chamber that is capable of being fluidly coupled to the bore of a barrel of the firearm through a gas inlet port, the gas cylinder being capable of receiving a gas pressure generated in the barrel of the firearm; and a gas pressure relief port fluidly coupled to the gas cylinder and to the bore of the barrel of the firearm, the gas pressure relief port venting gas pressure in the gas cylinder into the bore of the barrel of the firearm when the gas pressure in the gas cylinder is greater than or equal to a predetermined gas pressure.

2. The gas block assembly according to claim 1, further comprising a pressure relief mechanism fluidly coupled between the gas cylinder and the gas pressure relief port, the pressure relief mechanism capable of venting gas pressure from the gas cylinder to the gas pressure relief port when the gas pressure in the gas cylinder is greater than or equal to the predetermined gas pressure, the pressure relief mechanism comprising:

a pressure member fluidly coupled to the gas cylinder capable of being moved when the gas pressure in the gas cylinder is greater than or equal to the predetermined gas pressure; and a pressure adjustment member coupled to the pressure member, the pressure adjustment member capable of adjusting a force that is applied to the pressure member to oppose the pressure in the gas cylinder to selectably set the force to be substantially equal to the predetermined gas pressure that moves the pressure member.

3. The gas block assembly according to claim 2, wherein the pressure member comprises:

a piston member comprising a surface fluidly coupled to the gas cylinder; and a spring member mechanically coupled to the piston member, the spring member capable of generating a the force that is applied to the piston member to oppose the pressure in the gas cylinder, and wherein the pressure adjustment member comprises an adjustable screw member.

4. The gas block assembly according to claim 3, wherein the firearm comprises a semi-automatic firearm, a fully automatic firearm, or a combination thereof.

5. The gas block assembly according to claim 1, wherein the firearm comprises a semi-automatic firearm, a fully automatic firearm, or a combination thereof.

6. A gas block assembly for a firearm, comprising:

a gas cylinder defining a pressure chamber that is capable of being fluidly coupled to the bore of a barrel of the firearm through a gas inlet port, the gas cylinder being capable of receiving a gas pressure generated in the barrel of the firearm; and a pressure relief mechanism fluidly coupled to the gas cylinder, the pressure relief mechanism capable of venting gas pressure from the gas cylinder when the gas pressure in the gas cylinder is greater than or equal to a predetermined gas pressure, the pressure relief mechanism comprising:

a pressure member fluidly coupled to the gas cylinder capable of being moved when the gas pressure in the gas cylinder is greater than or equal to the predetermined gas pressure; and a pressure adjustment member coupled to the pressure member, the pressure adjustment member capable of adjusting a force that is applied to the pressure member to oppose the pressure in the gas cylinder to selectably set the force to be substantially equal to the predetermined gas pressure that moves the pressure member.

7. The gas block assembly according to claim 6, further comprising a gas pressure relief port fluidly coupled between the pressure relief mechanism and an atmosphere that is exterior to the gas cylinder, and wherein the pressure relief mechanism vents pressure from the gas cylinder to the gas pressure relief port when the gas pressure in the gas cylinder is greater than or equal to the predetermined gas pressure.

8. The gas block assembly according to claim 7, wherein the pressure member comprises:

a piston member comprising a surface fluidly coupled to the gas cylinder; and a spring member mechanically coupled to the piston member, the spring member capable of generating a the force that is applied to the piston member to oppose the pressure in the gas cylinder, and wherein the pressure adjustment member comprises an adjustable screw member.

9. The gas block assembly according to claim 8, wherein the block assembly is used remotely from, or adjacent to, or integrally with the mechanical loading and ejection components of the firearm.

10. The gas block assembly according to claim 8, wherein the firearm comprises a semi-automatic firearm, a fully automatic firearm, or a combination thereof.

11. The gas block assembly according to claim 10, wherein the block assembly is used remotely from, or adjacent to, or integrally with the mechanical loading and ejection components of the firearm.

12. The gas block assembly according to claim 8, wherein the pressure relief mechanism vents gas pressure from the gas cylinder to a sound suppressor or to a port that is capable of being fluidly coupled to a sound suppressor.

13. The gas block assembly according to claim 6, further comprising a gas pressure relief port fluidly coupled between the pressure relief mechanism and the bore of the barrel of the firearm, wherein the pressure relief mechanism venting pressure from the gas cylinder to the gas pressure relief port when the gas pressure in the gas cylinder is greater than or equal to the predetermined gas pressure.

14. The gas block assembly according to claim 13, wherein the firearm comprises a semi-automatic firearm, a fully automatic firearm, or a combination thereof.

15. The gas block assembly according to claim 6, wherein the firearm comprises a semi-automatic firearm, a fully automatic firearm, or a combination thereof.

16. The gas block assembly according to claim 15, wherein the block assembly is used remotely from, or adjacent to, or integrally with the mechanical loading and ejection components of the firearm.

17. The gas block assembly according to claim 16, wherein the pressure relief mechanism vents gas pressure from the gas cylinder to a sound suppressor or to a port that is capable of being fluidly coupled to a sound suppressor.

18. The gas block assembly according to claim 15, wherein the pressure relief mechanism vents gas pressure from the gas cylinder to a sound suppressor or to a port that is capable of being fluidly coupled to a sound suppressor.

19. The gas block assembly according to claim 6, wherein the pressure relief mechanism vents gas pressure from the gas cylinder to a sound suppressor or to a port that is capable of being fluidly coupled to a sound suppressor.

20. A gas block assembly for a firearm, comprising:

a gas cylinder defining a pressure chamber that is capable of being fluidly coupled to the bore of a barrel of the firearm through a gas inlet port, the gas cylinder being capable of receiving a gas pressure generated in the barrel of the firearm; and a gas pressure relief port fluidly coupled to the gas cylinder and to the bore of the barrel of the firearm or to a sound suppressor, or a combination thereof, the gas pressure relief port venting gas pressure in the gas cylinder into the bore of the barrel or the sound suppressor, or a combination thereof, of the firearm when the gas pressure in the gas cylinder is greater than or equal to a predetermined gas pressure.

* * * * *